US010060014B2

(12) United States Patent
Cha et al.

(10) Patent No.: US 10,060,014 B2
(45) Date of Patent: Aug. 28, 2018

(54) BEARING STEEL HAVING IMPROVED FATIGUE DURABILITY AND METHOD OF MANUFACTURING THE SAME

(71) Applicant: Hyundai Motor Company, Seoul (KR)

(72) Inventors: Sung-Chul Cha, Seoul (KR); Si-Yup Lee, Uiwang-si (KR); Young-Sang Ko, Gunpo-si (KR); Moon-Ki Bae, Hwaseong-si (KR); Seung-Hyun Hong, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 316 days.

(21) Appl. No.: 14/918,257

(22) Filed: Oct. 20, 2015

(65) Prior Publication Data

US 2016/0145724 A1 May 26, 2016

(30) Foreign Application Priority Data

Nov. 21, 2014 (KR) ..... 10-2014-0163799

(51) Int. Cl.

| | |
|---|---|
| ***C21D 1/32*** | (2006.01) |
| ***C22C 38/02*** | (2006.01) |
| ***C21D 8/06*** | (2006.01) |
| ***C21D 9/52*** | (2006.01) |
| ***C21D 1/18*** | (2006.01) |

(52) U.S. Cl.

CPC ..... *C22C 38/02* (2013.01); *C21D 1/18* (2013.01); *C21D 1/32* (2013.01); *C21D 8/065* (2013.01); *C21D 9/525* (2013.01)

(58) Field of Classification Search

CPC ..... C22C 38/02; C22C 38/04; C22C 38/06; C22C 38/08; C22C 38/12; C22C 38/16; C22C 38/18; C22C 38/20; C22C 38/24; C22C 38/26; C22C 38/34; C22C 38/40; C22C 38/42; C22C 38/46; C22C 38/48; C21D 1/18; C21D 1/32; C21D 8/06; C21D 8/065; C21D 9/525

See application file for complete search history.

(56) References Cited

FOREIGN PATENT DOCUMENTS

| | | | | | |
|---|---|---|---|---|---|
| CN | 103122433 | A | | 5/2013 | |
| JP | H05117804 | A | | 5/1993 | |
| JP | 2014189876 | A | * | 10/2014 | |
| KR | 10-2007-0074664 | A | | 7/2007 | |
| KR | 10-2013-0037227 | A | | 4/2013 | |
| WO | WO-2013156091 | A1 | * | 10/2013 | ..... C21D 9/40 |
| WO | 2014/053385 | A1 | | 4/2014 | |

* cited by examiner

*Primary Examiner* — Colleen P Dunn
*Assistant Examiner* — Anthony M Liang
(74) *Attorney, Agent, or Firm* — McDermott Will & Emery LLP

(57) ABSTRACT

A bearing steel includes 1.0 to 1.3 wt % carbon; 0.9 to 1.6 wt % silicon; 0.5 to 1.0 wt % manganese; 1.5 to 2.5 wt % nickel; 1.5 to 2.5 wt % chromium; 0.2 to 0.5 wt % molybdenum; 0.01 to 0.06 wt % aluminum; 0.01 to 0.1 wt % copper; at least one selected from the group consisting of more than 0 wt % and less than 0.38 wt % vanadium and more than 0 wt % and less than 0.02 wt % niobium; and a balance of iron.

4 Claims, No Drawings

BEARING STEEL HAVING IMPROVED FATIGUE DURABILITY AND METHOD OF MANUFACTURING THE SAME

CROSS-REFERENCE TO RELATED APPLICATIONS

This application claims priority under 35 U.S.C. § 119 to Korean Patent Application No. 10-2014-0163799, filed on Nov. 21, 2014, in the Korean Intellectual Property Office, the entirety of which is incorporated herein by reference.

TECHNICAL FIELD

The present disclosure relates to a bearing steel having improved fatigue durability and a method of manufacturing the same, and to a bearing steel containing a spheroidized complex carbide to provide excellent hardness and strength and an improved fatigue life and the like, and a method of manufacturing the same.

BACKGROUND

In the vehicular industry, various environmentally-friendly vehicles have been developed with the object of reducing a discharge amount of carbon dioxide to 95 g/km, which is 27% of the current amount thereof by 2021 based on European regulations. Furthermore, vehicle makers strive to develop technology to downsize and improve fuel economy in order to satisfy 54.5 mpg (23.2 km/1), which is a regulation for corporate average fuel economy (CAFE) in the USA by 2025.

In particular, high-performance and high-efficiency technology for engines and transmissions for maximizing fuel economy of vehicles has been developed, and this technology includes an increase in the number of gears, novel concept driveaway devices, high efficiency two-pump systems, fusion hybrid technology, technologies relating to an automatic/manual fusion transmission and a hybrid transmission, and the like.

Specialized steel for uses in transmissions is used in a carrier, a gear, an annulus gear, shafts, a synchronizer hub, and the like of the transmission. A use ratio of the specialized steel is currently about 58 to 62 wt % based on the total weight of the steel. For example, in a pinion shaft, a needle bearing, and an engine valve train-based roller swing arm of the transmission and the like, there is a continuous demand for developing a high-strength and high-durability material due to the requirements of reducing weight and downsizing, and until now, an SUJ2 steel containing 1.5 wt % of chromium (Cr) has been used.

However, because of increased severity of conditions due to downsizing and also a size reduction of parts such as the bearing and the like, durability of the material is reduced which causes damage to the surface and, when there is no lubrication, increases a surface temperature and reduces hardness in a high-temperature and high-revolution environment.

For example, for a bearing serving to fix a rotation shaft to a predetermined position, support a weight of the shaft and a load applied to the shaft, and rotate the shaft, a repeated load is applied in proportion to a rotation number. In order to endure the repeated load, fatigue resistance, wear resistance, and the like are required.

Generally, a bearing steel is subjected to steelmaking in a converter or an electric furnace, refined in a ladle while a strong reducing atmosphere is maintained to reduce an amount of a non-metallic inclusions, refined in a state where an oxygen content is reduced to 12 ppm or less through a vacuum degassing process, thereafter, solidified into a cast slab or a steel ingot by a casting process, subjected to crack diffusion treatment in order to remove segregation and large carbides existing at the center of the material, and rolled.

Thereafter, an intensely slow cooling operation is performed in order to soften the material in a rolling factory to produce a bearing steel wire rod or rod material, and the produced wire rod is produced into bearing products through spheroidizing heat-treating, forging, quenching, tempering, and grinding processes and the like.

During the aforementioned manufacturing process, a spheroidizing heat-treating process is mainly performed by diffusion at high temperatures, and globular particles are grown through a process similar to an Ostwald ripening principle to form a spheroidized tissue.

However, because the spheroidizing process is a process requiring growth of the globular particles, a long time is spent for spheroidizing, and thus manufacturing cost is increased. It is difficult to secure sufficient strength and durability life due to an increase in severity of the bearing because of downsizing, size reduction, and the like.

SUMMARY

The present disclosure has been made in an effort to provide a bearing steel having improved strength, durability life, and the like by effectively forming a spheroidized complex carbide finely in the bearing steel by adjusting a component and a content of an alloy of the bearing steel and controlling a process condition.

An exemplary embodiment of the present disclosure provides a bearing steel may comprise, based on a total weight of the bearing steel, 1.0 to 1.3 wt % carbon; 0.9 to 1.6 wt % silicon; 0.5 to 1.0 wt % manganese; 1.5 to 2.5 wt % nickel; 1.5 to 2.5 wt % chromium; 0.2 to 0.5 wt % molybdenum; 0.01 to 0.06 wt % aluminum; 0.01 to 0.1 wt % copper; at least one selected from the group consisting of more than 0 wt % and less than 0.38 wt % vanadium and more than 0 wt % and less than 0.02 wt % niobium; and a balance of iron.

The bearing steel may contain at most 0.006 wt % nitrogen, 0.001 wt % oxygen, 0.03 wt % phosphorus, and 0.01 wt % sulfur.

A method of manufacturing a bearing steel may comprise steps of primarily spheroidizing a wire rod of an alloy comprising, based on a total weight of the bearing steel, 1.0 to 1.3 wt % carbon; 0.9 to 1.6 wt % silicon; 0.5 to 1.0 wt % manganese; 1.5 to 2.5 wt % nickel; 1.5 to 2.5 wt % chromium; 0.2 to 0.5 wt % molybdenum; 0.01 to 0.06 wt % aluminum; 0.01 to 0.1 wt % copper; at least one selected from the group consisting of more than 0 wt % and less than 0.38 wt % of vanadium and more than 0 wt % and less than 0.02 wt % of niobium; and a balance of iron at 720 to 850° C. for 4 to 8 hours; wire-drawing the primarily spheroidized wire rod; secondarily spheroidizing the wire-drawn wire rod at 720 to 850° C. for 4 to 8 hours; forging the secondarily spheroidized wire rod to form the bearing steel; and quenching, rapidly cooling, and tempering the bearing steel.

The step of quenching may be performed at 840 to 860° C. for 0.5 to 2 hours, and the tempering is performed at 150 to 190° C. for 0.5 to 2 hours.

The step of primarily spheroidizing the wire rod may include spheroidizing at least one selected from the group consisting of $Me_3C$, $Me_7C_3$, $Me_{23}C_6$, and MeC carbides, where Me is a metal ion.

Me of the $Me_3C$, $Me_7C_3$, and $Me_{23}C_6$ carbides may be at least one selected from the group consisting of chromium, iron, and manganese.

Me of the MeC carbide may be at least one selected from the group consisting of chromium, iron, vanadium, niobium, and molybdenum.

In an exemplary embodiment of the present inventive concept having the aforementioned constitution, it is possible to facilitate a thickness reduction, a weight reduction, degree of freedom in design, and the like of vehicles using a bearing steel and secure a reduction of costs and the like by finely forming a complex carbide and the like in the bearing steel to improve strength, hardness, fatigue life, and the like of the bearing steel and facilitate high strengthening.

DETAILED DESCRIPTION

Terms or words used in the present specification and claims should not be interpreted as being limited to typical or dictionary meanings, but should be interpreted as having meanings and concepts which comply with the technical spirit of the present inventive concept, based on the principle that an inventor can appropriately define the concept of the term to describe his/her own inventive concept in the best manner.

Hereinafter, the present inventive concept will be described in detail. The present inventive concept relates to a bearing steel having improved fatigue durability, such as fatigue strength and fatigue life, which may be applied to engines and transmissions of vehicles and the like, and a method of manufacturing the same.

The bearing steel according to the present inventive concept may include carbon (C), silicon (Si), manganese (Mn), nickel (Ni), chromium (Cr), molybdenum (Mo), aluminum (Al), and copper (Cu), and may additionally include one or more selected from the group consisting of vanadium (V) and niobium (Nb), and additionally includes iron (Fe) of a balance, an inevitable impurity, and the like. Herein, the impurity may include one or more selected from the group consisting of nitrogen (N), oxygen (O), phosphorus (P), and sulfur (S).

For example, based on the total weight of the bearing steel, the content of carbon (C) may be 1.0 to 1.3 wt %, the content of silicon (Si) may be 0.9 to 1.6 wt %, the content of manganese (Mn) may be 0.5 to 1 wt %, the content of nickel (Ni) may be 1.5 to 2.5 wt %, the content of chromium (Cr) may be 1.5 to 2.5 wt %, the content of molybdenum (Mo) may be 0.2 to 0.5 wt %, the content of aluminum (Al) may be 0.01 to 0.06 wt %, the content of copper (Cu) may be 0.01 to 0.1 wt %, the content of vanadium (V) may be more than 0 wt % and less than 0.38 wt %, the content of niobium (Nb) may be more than 0 wt % and less than 0.02 wt %, the content of nitrogen (N) of the impurity may be 0.006 wt % or less, the content of oxygen (O) may be 0.001 wt % or less, the content of phosphorus (P) may be 0.03 wt % or less, and the content of sulfur (S) may be 0.01 wt % or less.

Meanwhile, the bearing steel according to one embodiment of the present inventive concept may include the spheroidized complex carbide and the like, and an element such as vanadium (V) and niobium (Nb) is an element that may be used to form the spheroidized complex carbide.

In one embodiment of the present inventive concept, a complex carbide including $Me_3C$, $Me_7C_3$, and $Me_{23}C_6$ carbides, and a MeC carbide, are precipitates, which can be present in the steel. The complex carbide including the aforementioned carbides serves to improve strength and the like of the bearing steel and extend the durability life and the like.

For example, Me of the $Me_3C$, $Me_7C_3$, and $Me_{23}C_6$ carbides may be one or more selected from the group consisting of chromium (Cr), iron (Fe), manganese (Mn), and the like, and Me of the MeC carbide may be one or more selected from the group consisting of chromium (Cr), iron (Fe), vanadium (V), niobium (Nb), molybdenum (Mo), and the like.

Furthermore, the reason why a numerical value of each component is limited is as follows.

(1) 1.0 to 1.3 wt % of Carbon (C)

Carbon (C) is an element serving to strengthen the steel and stabilize the remaining austenite. Herein, in the case where the content of carbon (C) is less than 1.0 wt %, the steel is not sufficiently strengthened, and a reduction in fatigue strength and the like are caused. However, there are problems in that in the case where the content of carbon (C) is more than 1.3 wt %, the remaining undissolved carbide reduces fatigue strength, durability, and the like and may reduce processability before quenching and the like, and thus the content of carbon (C) may be limited to 1.0 to 1.3 wt %.

(2) 0.9 to 1.6 wt % of Silicon (Si)

Silicon (Si) is an element serving as a deoxidizer and strengthens the steel by a solid-solution strengthening effect and improving the activity of carbon (C). When the content of silicon (Si) is less than 0.9 wt %, oxide by oxygen not sufficiently removed remains in the steel, and thus the strength of the steel is reduced, and it is difficult to exhibit a sufficient solid-solution strengthening effect. However, when the content of silicon (Si) is more than 1.6 wt %, decarbonization may occur by an interpenetration reaction in a tissue, such as a site competition reaction with carbon (C) by the excessive content of silicon (Si), and processability is also reduced due to an increase in hardness before quenching, and thus the content of silicon (Si) may be limited to 0.9 to 1.6 wt %.

(3) 0.5 to 1.0 wt % of Manganese (Mn)

Manganese (Mn) is an element serving to improve a quenching property and improve toughness of the steel and thus improve a rolling fatigue life-span resistance property and the like. When the content of manganese (Mn) is less than 0.5 wt %, it is difficult to secure a sufficient quenching property, and thus processability may be reduced. However, when the content of manganese (Mn) is more than 1.0 wt %, since processability before quenching is reduced and MnS reducing center segregation and the fatigue life is precipitated, the content of manganese (Mn) may be limited to 0.5 to 1.0 wt %.

(4) 1.5 to 2.5 wt % of Nickel (Ni)

Nickel (Ni) is an element serving to micronize crystal grains of the steel, improve solid-solution strengthening, matrix strengthening, low temperature impact toughness, hardenability, and the like, reduce a temperature of an Al transformation point, help expansion of an austenite tissue, and improve activity of carbon and the like. When the content of nickel (Ni) is less than 1.5 wt %, it is difficult to sufficiently obtain an effect of micronization of the crystal grains, and it is difficult to obtain a sufficient improvement effect such as solid-solution strengthening and matrix strengthening. However, when the content of nickel (Ni) is more than 2.5 wt %, since red shortness and the like may occur in the steel, the content of nickel (Ni) may be limited to 1.5 to 2.5 wt %.

(5) 1.5 to 2.5 wt % of Chromium (Cr)

Chromium (Cr) is an element serving to improve a quenching property of the steel, provide hardenability, and simultaneously, micronize and spheroidize a tissue of the steel. When the content of chromium (Cr) is less than 1.5 wt %, the quenching property and hardenability may be limited, and sufficient micronization and spheroidizing of the tissue may not be obtained. However, when the content of chromium (Cr) is more than 2.5 wt %, insignificant increases in effect are seen with increases in content, but there is increased manufacturing cost. The content of chromium (Cr) may be limited to 1.5 to 2.5 wt %.

(6) 0.2 to 0.5 wt % of Molybdenum (Mo)

Molybdenum (Mo) is an element serving to improve the fatigue life of the steel by increasing the quenching property or strength of the steel after tempering. When the content of molybdenum (Mo) is less than 0.2 wt %, the fatigue life of the steel is not sufficiently improved, and when the content of molybdenum (Mo) is more than 0.5 wt %, processability and productivity of the steel and the like may be reduced. The content of molybdenum (Mo) may be limited to 0.2 to 0.5 wt %.

(7) 0.01 to 0.06 wt % of Aluminum (Al)

Aluminum (Al) is an element serving as a strong deoxidizer and serving to improve cleanliness of the steel and be reacted with nitrogen (N) in the steel to form nitride and thus micronize the crystal grains. When the content of aluminum (Al) is less than 0.01 wt %, it is difficult to obtain a sufficient effect relating to the deoxidizer, cleanliness, and micronization of the crystal grains. However, when the content of aluminum (Al) is more than 0.06 wt %, a coarse oxide inclusion and the like are formed that reduce the fatigue life of the steel and the like. The content of aluminum (Al) may be limited to 0.01 to 0.06 wt %.

(8) 0.01 to 0.1 wt % of Copper (Cu)

Copper (Cu) is an element serving to improve hardenability of the steel and the like. When the content of copper (Cu) is less than 0.01 wt %, an effect of sufficient hardenability improvement may not be obtained, and when the content of copper (Cu) is more than 0.1 wt %, a solid solubility limit is exceeded, so that an effect of strength improvement of the steel is saturated to increase a manufacturing cost and cause red shortness. The content of copper (Cu) may be limited to 0.01 to 0.1 wt %.

(9) More than 0 wt % and Less than 0.38 wt % of Vanadium (V)

Vanadium (V) is an element serving to form precipitates such as the carbide and the like, reinforce a matrix tissue through a precipitation reinforcing effect, improve strength and wear resistance, and micronize crystal grains, and enabling high strengthening at the relatively same cooling rate as SUJ2. When the content of vanadium (V) is more than 0.38 wt %, toughness and hardness of the steel may be reduced. The content of vanadium (V) may be limited to more than 0 wt % and less than 0.38 wt %.

(10) More than 0 wt % and Less than 0.02 wt % of Niobium (Nb)

Niobium (Nb) is an element which is combined with carbon and nitrogen at high temperatures to serve to form a carbide and a nitride, respectively, and improve strength and low temperature toughness of the steel. When the content of niobium (Nb) is more than 0.02 wt %, an improvement rate of strength and low temperature toughness of the steel is low as compared to the increased content, so that a manufacturing cost is excessively administered as compared to an effect that may be obtained, and niobium (Nb) exists in a solid solution state in ferrite and impact toughness is reduced. The content of niobium (Nb) be limited to more than 0 wt % and less than 0.02 wt %.

(11) 0.006 wt % or Less of Nitrogen (N)

Nitrogen (N) is an impurity that reacts with aluminum (Al) to form AlN and thus reduces the durability life of the steel and the like, so the content of nitrogen (N) may be limited to 0.006 wt % or less.

(12) 0.001 wt % or Less of Oxygen (O)

Oxygen (O) is an impurity reducing cleanliness of the steel and degrading the steel through contact fatigue, so the content of oxygen (O) may be limited to 0.001 wt % or less.

(13) 0.03 wt % or Less of Phosphorus (P)

Phosphorus (P) is an impurity inducing segregation of a crystal grain boundary to reduce toughness of the steel, so the content of phosphorus (P) may be limited to 0.03 wt % or less.

(14) 0.01 wt % or Less of Sulfur (S)

Sulfur (S) increases machinability of the steel to make processing easy, but sulfur (S) also reduces toughness of the steel by grain boundary segregation and reacts with manganese (Mn) to form MnS and thus reduce the fatigue life of the steel. The content of sulfur (S) may be limited to 0.01 wt % or less.

The bearing steel having improved fatigue durability according to the present inventive concept may be applied to vehicles and the like, and the bearing steel may be applied to engines and transmissions of the vehicles and the like.

Hereinafter, in another aspect, the present inventive concept relates to a method of manufacturing a bearing steel having improved fatigue durability.

The method of manufacturing the bearing steel having improved fatigue durability according to the present inventive concept includes a first step of primarily spheroidizing heat-treating a wire rod of an alloy including, based on a total weight of the bearing steel, 1.0 to 1.3 wt % of carbon (C), 0.9 to 1.6 wt % of silicon (Si), 0.5 to 1.0 wt % of manganese (Mn), 1.5 to 2.5 wt % of nickel (Ni), 1.5 to 2.5 wt % of chromium (Cr), 0.2 to 0.5 wt % of molybdenum (Mo), 0.01 to 0.06 wt % of aluminum (Al), and 0.01 to 0.1 wt % of copper (Cu), additionally including one or more selected from the group consisting of more than 0 wt % and less than 0.38 wt % of vanadium (V) and more than wt % and less than 0.02 wt % of niobium (Nb), and additionally including a balance of iron (Fe), an inevitable impurity, and the like at a temperature of about 720 to 850° C. for about 4 to 8 hours to spheroidize a complex carbide. The primarily spheroidizing heat-treated wire rod is wire-drawn in a second step. In a third step, the wire-drawn wire rod is secondarily spheroidized heat-treated at a temperature of about 720 to 850° C. for about 4 to 8 hours to spheroidize the complex carbide. The secondarily spheroidized heat-treated wire rod is forged in a fourth step to form the bearing steel, and the bearing steel is quenched, rapidly cooled, and tempered, and the like in a fifth step.

In the method of manufacturing the bearing steel, a complex carbide is formed and spheroidized, and the complex carbide includes $Me_3C$, $Me_7C_3$, and $Me_{23}C_6$ carbides, and MeC carbides that are precipitates, and the like. The complex carbide including the aforementioned carbides serves to improve strength of the bearing steel and the like and extend the durability life and the like.

Herein, Me of the $Me_3C$ and $Me_7C_3$ carbides and the $Me_{23}C_6$ carbide may be one or more selected from the group consisting of chromium (Cr), iron (Fe), manganese (Mn), and the like, and Me of the MeC carbide may be one or more selected from the group consisting of chromium (Cr), iron (Fe), vanadium (V), niobium (Nb), molybdenum (Mo), and the like.

Meanwhile, the quenching of the fifth step of the manufacturing method may be performed at a temperature of about 840 to 860° C. for about 0.5 to 2 hours, and the tempering may be performed at a temperature of about 150 to 190° C. for about 0.5 to 2 hours.

In the case where the quenching temperature is less than about 840° C. or the quenching time is less than about 0.5 hours, since a quenched tissue is nonuniform, a material deviation may occur, and in the case where the quenching temperature is more than about 860° C. or the quenching time is more than about 2 hours, the spheroidized complex carbide formed by primary and secondary spheroidizing heat-treating may be dissolved.

In the case where the tempering temperature is less than about 150° C. or the tempering time is less than about 0.5 hours, since it is difficult to secure physical properties such as toughness of the bearing steel, and in the case where the tempering temperature is more than about 190° C. or the tempering time is more than about 2 hours, since hardness of the bearing steel and the like are rapidly reduced, it may be difficult to improve the durability life.

Meanwhile, in the case where the primary spheroidizing heat-treating temperature of the first step and the secondary spheroidizing heat-treating temperature of the third step are each less than about 720° C. or the spheroidizing heat-treating time is less than about 4 hours, a lot of spheroidizing time of the complex carbide is required, and thus a manufacturing cost may be rapidly increased.

On the other hand, in the case where the primary and secondary spheroidizing heat-treating temperatures are more than about 850° C., since the formed complex carbide is dissolved, a possibility of forming a lamella-type complex carbide instead of a spherical complex carbide during a cooling process is significantly increased.

In the case where the primary and secondary spheroidizing heat-treating times are more than about 8 hours, a spheroidizing rate of the complex carbide may be slowed to rapidly increase the manufacturing cost.

EXAMPLE

Hereinafter, the present inventive concept will be described in more detail through the Examples. These Examples are only for illustrating the present inventive concept, and it will be obvious to those skilled in the art that the scope of the present inventive concept is not interpreted to be limited by these Examples.

In order to check physical properties such as hardness and the durability life of the bearing steel manufactured according to the present inventive concept, Comparative Examples 1 to 4 and Examples 1 to 3 having the components as described in the following Table 1 were manufactured.

TABLE 1

| Classification | Comp. Ex. 1 | Comp. Ex. 2 | Comp. Ex. 3 | Comp. Ex. 4 | Ex. 1 | Ex. 2 | Ex. 3 |
|---|---|---|---|---|---|---|---|
| C | 1.00 | 1.35 | 1.28 | 1.02 | 1.21 | 1.01 | 1.28 |
| Si | 0.27 | 1.41 | 1.03 | 0.98 | 1.04 | 1.43 | 1.02 |
| Mn | 0.38 | 0.72 | 0.69 | 0.82 | 0.61 | 0.71 | 0.67 |
| P | 0.012 | 0.013 | 0.012 | 0.011 | 0.012 | 0.011 | 0.012 |
| S | 0.005 | 0.004 | 0.005 | 0.004 | 0.005 | 0.005 | 0.004 |
| Cu | 0.05 | 0.053 | 0.045 | 0.042 | 0.047 | 0.05 | 0.043 |
| Ni | 0.05 | 1.83 | 1.59 | 1.62 | 1.57 | 1.81 | 2.15 |
| Cr | 1.46 | 1.53 | 1.59 | 1.63 | 1.56 | 1.73 | 2.23 |
| Mo | 0.02 | 0.26 | 0.24 | 0.29 | 0.23 | 0.25 | 0.28 |
| Al | 0.017 | 0.025 | 0.027 | 0.017 | 0.023 | 0.014 | 0.016 |
| N | 0.0035 | 0.0052 | 0.0049 | 0.0042 | 0.0053 | 0.0051 | 0.0052 |
| O | 0.0006 | 0.0004 | 0.0003 | 0.0006 | 0.0005 | 0.0004 | 0.0004 |
| V | — | — | 0.42 | — | — | 0.27 | 0.19 |
| Nb | — | — | — | 0.03 | 0.018 | 0.013 | — |
| Fe | Balance | Balance | Balance | Balance | Balance | Balance | Balance |

Unit: wt %

In Comparative Examples 1 to 4 and Examples 1 to 3 of Table 1, during the manufacturing process, the primary spheroidizing heat-treating temperature was set to about 800° C., the secondary spheroidizing heat-treating temperature was set to about 720° C., the quenching temperature and time were set to about 850° C. and about 1 hour, respectively, and the tempering temperature and time were set to about 150° C. and about 1 hour, respectively.

Comparative Examples 1 to 4 did not include one or more of vanadium (V) and niobium (Nb), or even though one or more were included, the content range of vanadium (V) or niobium (Nb) exceeded the content range of the present inventive concept.

On the contrary, Examples 1 to 3 included one or more of vanadium (V) and niobium (Nb), and the content range thereof satisfied the content ranges of the present inventive concept.

As described above, in order to check the difference between physical properties of Comparative Examples 1 to 4 and Examples 1 to 3 having different components and contents, the physical properties are compared and arranged in the following Table 2.

TABLE 2

| Classification | Hardness at room temperature (HV) | Hardness at 300° C. (HV) | Rotation number of rotation bending fatigue tester at 150° C./6.2 GPa surface pressure (L10 life, times) | Durability life comparison (%) |
|---|---|---|---|---|
| Comparative Example 1 | 720 | 698 | 8,400,000 | 100 |
| Comparative Example 2 | 760 | 744 | 9,200,000 | 110 |
| Comparative Example 3 | 770 | 752 | 8,600,000 | 102 |
| Comparative Example 4 | 780 | 758 | 8,800,000 | 105 |
| Example 1 | 820 | 803 | 16,968,000 | 202 |
| Example 2 | 840 | 823 | 18,069,000 | 215 |
| Example 3 | 830 | 816 | 17,573,000 | 209 |

Table 2 is a table where hardenesses at room temperature, hardenesses at 300° C., the rotation numbers of the rotation bending fatigue tester to the L10 life under the surface pressure condition of 6.2 GPa at 150° C., and the durability lives considering these hardenesses and rotation numbers of the Comparative Examples and the Examples are compared.

Herein, in the case of the hardness, the KS B 0811 measurement method using the Micro Vickers Hardness tester was used. As seen through Table 2, it could be seen that the hardness at room temperature of 25° C. was higher by about 10% in Examples 1 to 3 than in Comparative Examples 1 to 4, and the hardness in the state heated to 300° C. was also higher by about 10% in Examples 1 to 3 than in Comparative Examples 1 to 4.

The rotation number of the rotation bending fatigue tester was measured at 150° C. and the L10 life of the standard line diameter of 4 mm was measured by the KS B ISO 1143 measurement method where the rotation bending fatigue tester was used. The L10 life is the rating fatigue life of the specimen, and means the total rotation number of the rotation bending fatigue tester until 10% of the specimen is damaged.

In this case, it could be seen that in the case of the rotation number of the rotation bending fatigue tester with respect to the L10 life under the surface pressure condition of 6.2 GPa at 150° C., the average value of Examples 1 to 3 was 17,536,667 times and was about two times higher than 8,750,000 times that was the average value of Comparative Examples 1 to 4.

In order to compare the durability lives of Comparative Examples 1 to 4 and Examples 1 to 3 based on the rotation number of the rotation bending fatigue tester, 8,400,000 times that was the rotation number of the rotation bending fatigue tester of Comparative Example 1 was set as the standard of the durability life of 100%, and based on the rotation number of the rotation bending fatigue tester of Comparative Example 1 as the standard, the increase or the decrease between the rotation numbers of the rotation bending fatigue tester of Comparative Examples 2 to 4 and Examples 1 to 3 was represented as the percentage.

That is, the percentage for comparing the durability lives of Comparative Examples 1 to 4 and Examples 1 to 3 is a value representing the degree of relative increase and decrease of the rotation numbers of the rotation bending fatigue tester of the residual Comparative Examples 2 to 4 and Examples 1 to 3 based on Comparative Example 1.

Herein, through comparison of the durability lives of the Comparative Examples and the Examples, it could be seen that like the rotation number of the rotation bending fatigue tester, the durability life of Examples 1 to 3 was about two times higher than the durability life of Comparative Examples 1 to 4.

Therefore, it could be experimentally confirmed that Examples 1 to 3 satisfying the components and the content range according to the present inventive concept and manufactured through the heat-treating process according to the present inventive concept included various complex carbides and the like, and thus had strength and the durability life that were better than those of Comparative Examples 1 to 4.

As described above, the present inventive concept has been described in relation to specific embodiments of the present inventive concept, but the embodiments are only illustrative and the present inventive concept is not limited thereto. Embodiments described may be changed or modified by those skilled in the art to which the present inventive concept pertains without departing from the scope of the present inventive concept, and various alterations and modifications are possible within the technical spirit of the present inventive concept and the equivalent scope of the claims which will be described below.

What is claimed is:

1. A bearing steel consisting of: based on a total weight of the bearing steel, 1.0 to 1.3 wt % carbon;
0.9 to 1.6 wt % silicon;
0.5 to 1.0 wt % manganese;
1.5 to 2.5 wt % nickel;
1.5 to 2.5 wt % chromium;
0.2 to 0.5 wt % molybdenum;
0.01 to 0.06 wt % aluminum;
0.01 to 0.1 wt % copper;
at least one selected from the group consisting of more than 0 wt % and less than 0.38 wt % vanadium and more than 0 wt % and less than 0.02 wt % niobium; and a balance of iron and inevitable impurities;
wherein the bearing steel is characterized in that spheroidized complex carbides including $Me_3C$, $Me_7C_3$, $Me_{23}C_6$, or MeC carbides, where Me is a metal ion, is contained therein.

2. The bearing steel of claim 1, wherein the bearing steel contains at most 0.006 wt % nitrogen, 0.001 wt % oxygen, 0.03 wt % phosphorus, and 0.01 wt % sulfur as inevitable impurities.

3. The bearing steel of claim 1, wherein Me of the MeC carbide is one or more selected from the group consisting of chromium, iron, vanadium, niobium, and molybdenum.

4. The bearing steel of claim 1, wherein Me of the $Me_3C$, $Me_7C_3$, and $Me_{23}C_6$ carbides is at least one selected from the group consisting of chromium, iron, and manganese.

* * * * *